United States Patent [19]

Greenblatt

[11] Patent Number: 5,033,132

[45] Date of Patent: Jul. 23, 1991

[54] ROLL-UP SHOWER CURTAIN

[76] Inventor: Herbert Greenblatt, 3809 Dunhill Rd., Wantagh, N.Y. 11793

[21] Appl. No.: 595,985

[22] Filed: Oct. 11, 1990

[51] Int. Cl.[5] ..... A47K 3/22

[52] U.S. Cl. ..... 4/608; 4/558; 4/610; 4/607; 160/23.1; 160/123; 160/238; 160/DIG. 6

[58] Field of Search ..... 4/558, 610, 557, 559, 4/605, 607, 608, 609; 160/128, 133, 238, 23.5, DIG. 6, DIG. 10, 23.1, 67, 77, 70, 66, 41, 84.1, 72, 37

[56] References Cited

U.S. PATENT DOCUMENTS

| | | | |
|---|---|---|---|
| 2,160,118 | 5/1939 | Brent | 160/128 X |
| 2,465,853 | 3/1949 | Dalton, Jr. | 4/558 |
| 2,481,397 | 9/1949 | Dalton, Jr. | 4/558 |
| 2,840,827 | 7/1958 | Calvano | 4/558 |
| 4,122,559 | 10/1978 | Kelly | 160/23.1 X |
| 4,916,764 | 4/1990 | Meaden | 160/23.1 X |

*Primary Examiner*—Henry K. Artis
*Attorney, Agent, or Firm*—Richard L. Miller

[57] ABSTRACT

A roll-up shower curtain for a bathtub and shower enclosure is provided and consists of an elongated casing, which carries a roller shaft, secured between the end walls of the shower enclosure by adjustable retainer members on the sides of the casing. A shower curtain can be readily raised and lowered on the roller shaft by manually operating the roller shaft. When the shower curtain is completely lowered it can slide within a recessed track in the roller shaft to be pushed to one side.

5 Claims, 2 Drawing Sheets

ROLL-UP SHOWER CURTAIN

BACKGROUND OF THE INVENTION

The instant invention relates generally to enclosure devices and more specifically it relates to a roll-up shower curtain.

Numerous enclosure devices have been provided in the prior art that are adapted to cover and protect particular areas in a building, such as showers and baths or the like.

For example, U.S. Pat. Nos. 580,697 to Kraemer; 1,824,673 to Lee; 1,898,233 to Woods; 1,968,719 to Smurr; 2,120,155 to Shera; 2,481,397 to Dalton, Jr.; 2,756,438 to Soberman; 2,776,439 to Rondinelli, 2,840,827 to Calvano; 2,914,775 to Kauffman; 3,050,742 to Munson; 3,110,343 to Guffan; 3,222,689 to Efron et al; 3,582,998 to Morse; 3,747,132 to Foster; 3,952,337 to Hansow; 3,965,960 to Massey; 4,068,816 to Anderson and 4,122,559 to Kelly all are illustrative of such prior art. While these units may be suitable for the particular purpose to which they address, they would not be as suitable for the purpose of the present invention as hereafter described.

SUMMARY OF THE INVENTION

A primary object of the present invention is to provide a roll-up shower curtain that will overcome the shortcomings of the prior art devices.

Another object is to provide a roll-up shower curtain which can be readily raised and lowered by manually operating a roller shaft and when the shower curtain is completely lowered it can slide within a track in the roller shaft to be pushed to one side.

An additional object is to provide a roll-up shower curtain that includes an elongated casing, which carries the roller shaft, secured between the end walls of a bathtub and shower enclosing by adjustable retainer members on the sides of the casing to cause axial compression forces through the casing.

A further object is to provide a roll-up shower curtain that is simple and easy to use.

A still further object is to provide a roll-up shower curtain that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
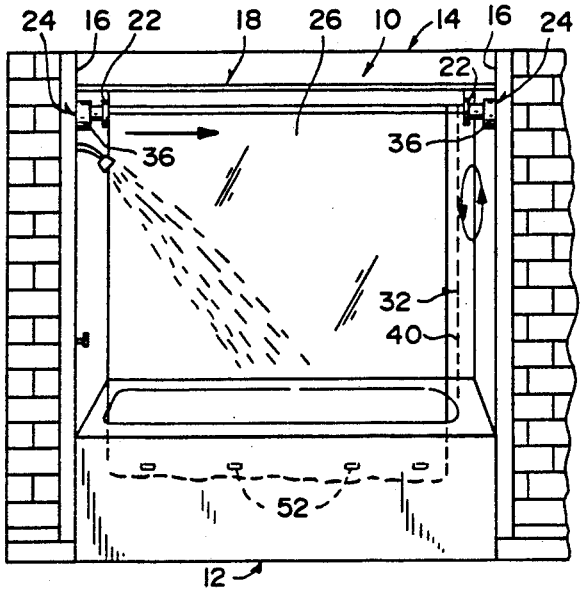
FIG. 1 is a diagrammatic perspective view of a combination bathtub and shower enclosure illustrating the instant invention with parts broken away, installed therein and ready for use.
Figure 2:
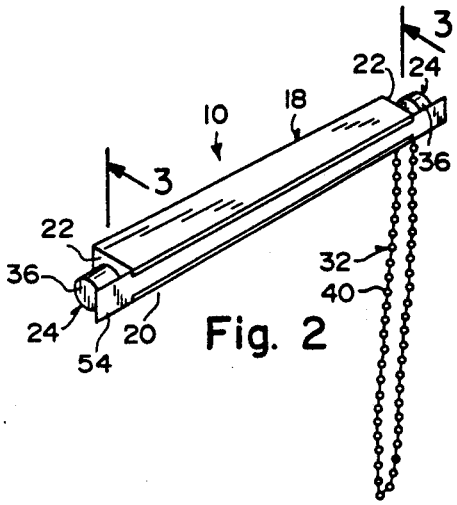
FIG. 2 is a diagrammatic perspective view of the instant invention per se with the shower curtain rolled up.
Figure 3:
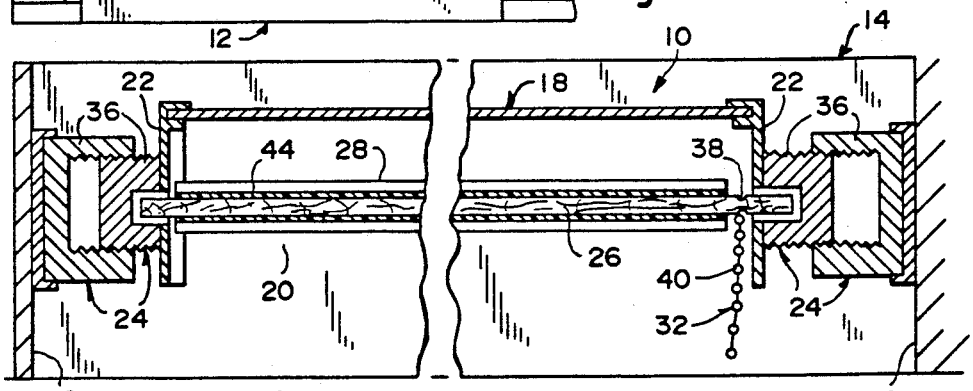
FIG. 3 is a diagrammatic cross sectional view taken on line 3—3 of FIG. 3.
Figure 4:
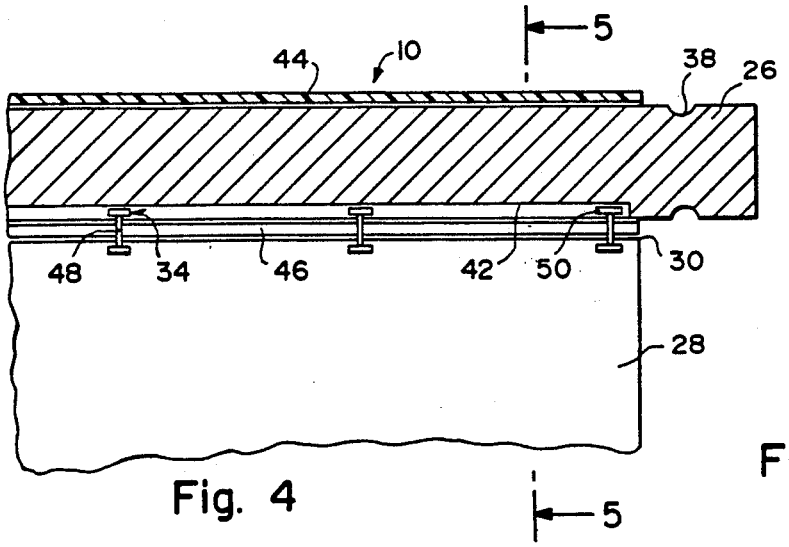
FIG. 4 is an enlarged diagrammatic partial perspective view taken on line 4—4 of FIG. 5 of just the roller and shower curtain per se.
Figure 5:
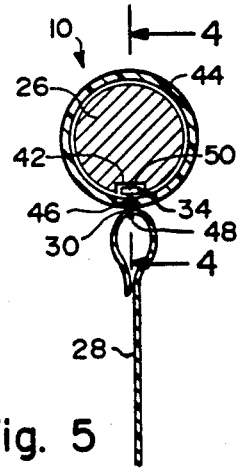
FIG. 5 is a cross sectional view taken on line 5—5 of FIG. 4.

Turning now descriptively to the drawings, in which like reference characters denote like elements throughout the several views, the Figures illustrate a roll-up shower curtain 10 for a bathtub 12 and shower enclosure 14 having opposite end walls 16. The invention consists of an elongated rectangular casing 18 having an opening 20 along the bottom thereof and a pair of side panels 22. A mechanism 24 is for mounting the side panels 22 of the casing 18 to the end walls 16. A roller shaft 26 is rotatively mounted between the side panels 22 of the casing 18, while a generally rectangular shower curtain 28 is retained along its upper edge 30 to the roller shaft 26. A mechanism 32 is for manually rotating the roller shaft 26 so that when the roller shaft is rotated, the shower curtain 28 will roll upon the roller shaft 26 in one direction and unroll down from the roller shaft in an opposite direction. A mechanism 34 is for allowing the upper edge 30 of the shower curtain 28 to slide along the roller shaft 26 when the shower curtain 28 is completely unrolled down so as to be pushed to one side.

Figure 6:
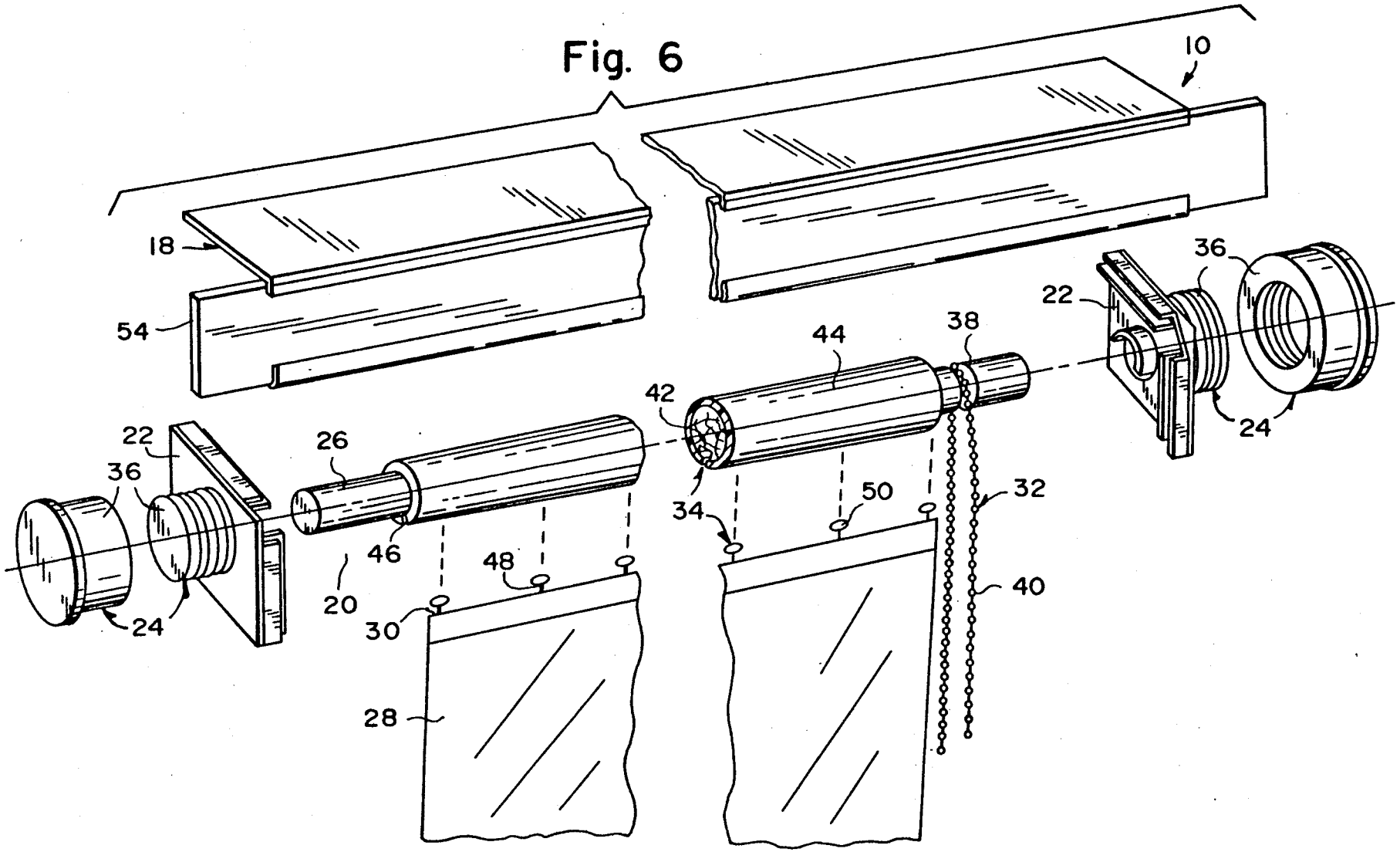
FIG. 6 is an exploded perspective view of the entire instant invention per se.

The mounting mechanism 24 is a pair of adjustable retainer members 36 each affixed to one of the side panels 22 of the casing 18. When the retainer members 36 are extended they will bear against each respective end wall 16 of the shower enclosure 14 to cause axial compression forces through the casing 18. A removable decorative member 54 is mounted on the front of the casing 18, as best seen in FIG. 6.

The manually rotating mechanism 32 includes the roller shaft 26 having an annular sprocket groove 38 formed about the circumference in one side thereof. A continuous elongated operating chain 40 extends about the annular sprocket groove 38. When a person pulls on one side of the operating chain 40 it will engage with and turn the annular sprocket groove 38 thus rotating the roller shaft 26.

The slide mechanism 34 includes the roller shaft 26 having an elongated recessed track 42. A sleeve 44 having an elongated slot 46 fits upon the roller shaft 26 so that the slot 46 will line up with the recessed track 42. A plurality of hangers 48 are provided with each having an enlarged head 50. The hangers 48 are spaced apart and affixed to the upper edge 30 of the shower curtain 28 with the heads 50 of the hangers 48 riding between the recessed track 42 in the roller shaft 26 and the slot 46 in the sleeve 44.

A plurality of magnets 52 are spaced apart and connected to the bottom of the shower curtain 28 so that the bottom of the shower curtain 28 will be retained against the inside of the bathtub 12 to prevent water leakage therefrom.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A roll-up shower curtain for a bathtub and shower enclosure having opposite end walls comprising:

a) an elongated rectangular casing having an opening along the bottom thereof and a pair of side panels;

b) means for mounting the side panels of said casing to the end walls of the shower enclosure so that said casing will be positioned horizontally between the end walls;

c) a roller shaft rotatively mounted between the side panels of said casing;

d) a generally rectangular shower curtain retained along its upper edge to said roller shaft;

e) means for manually rotating said roller shaft so that when said roller shaft is rotated said shower curtain will roll up on said roller shaft in one direction and unroll down from said roller shaft in an opposite direction; and f) means for allowing the upper edge of said shower curtain to slide along said roller shaft when said shower curtain is completely unrolled down so as to be pushed to one side.

2. A roll-up shower curtain as recited in claim 1, wherein said mounting means includes a pair of adjustable retainer members, each affixed to one of the side panels of said casing so that when said retainer members are extended they will bear against each respective end wall of the shower enclosure to cause axial compression forces through the casing.

3. A roll-up shower curtain as recited in claim 2, wherein said manually rotating means includes:

a) said roller shaft having an annular sprocket groove formed about the circumference in one side thereof; and b) a continuous elongated operating chain extending about said annular sprocket groove so that when a person pulls on one side of said operating chain it will engage with and turn said annular sprocket groove thus rotating said roller shaft.

4. A roll-up sower curtain as recited in claim 3, wherein said slide means includes:

a) said roller shaft having an elongated recessed track;

b) a sleeve having an elongated slot, whereby said sleeve fits upon said roller shaft so that said slot will line up with said recessed track; and c) a plurality of hangers, each having an enlarged head so that said hangers are spaced apart and affixed to the upper edge of said shower curtain with the heads of said hangers riding between the recessed track in said roller shaft and the slot in said sleeve.

5. A roll-up shower curtain as recited in claim 4, further including a plurality of magnets spaced apart and connected to the bottom of said shower curtain so that the bottom of said shower curtain will be retained against the inside of the bathtub to prevent water leakage therefrom.

* * * * *